United States Patent [19]

Gillich et al.

[11] 4,399,021

[45] Aug. 16, 1983

[54] NOVEL ELECTROLYTES FOR ELECTROCHEMICALLY TREATED METAL PLATES

[75] Inventors: Thomas N. Gillich, Whitehouse Station; John E. Walls, Annandale; Stanley F. Wanat, Scotch Plains; William J. Rozell, Martinsville, all of N.J.

[73] Assignee: American Hoechst Corporation, Somerville, N.J.

[21] Appl. No.: 359,457

[22] Filed: Mar. 18, 1982

Related U.S. Application Data

[63] Continuation-in-part of Ser. No. 188,092, Sep. 26, 1980, abandoned.

[51] Int. Cl.[3] ..... C25D 11/10; C25D 11/24

[52] U.S. Cl. ..... 204/38 A; 204/38 R; 204/56 R; 204/58; 101/459

[58] Field of Search ..... 204/58, 56 RM, 38 A, 204/38 R; 101/459

[56] References Cited

U.S. PATENT DOCUMENTS

| | | | |
|---|---|---|---|
| 2,578,400 | 12/1951 | Cohn | 204/58 |
| 2,918,416 | 12/1959 | Taylor | 204/58 |
| 3,307,951 | 3/1967 | Adams et al. | 96/86 |
| 3,857,766 | 12/1974 | Woods | 204/58 |

FOREIGN PATENT DOCUMENTS

| | | | |
|---|---|---|---|
| 2836878 | 11/1979 | German Democratic Rep. | 204/58 |
| 1090840 | 11/1967 | United Kingdom | 204/58 |

*Primary Examiner*—R. L. Andrews

*Attorney, Agent, or Firm*—Richard S. Roberts; Leo S. Burnett

[57] ABSTRACT

According to the invention there is provided an electrochemical process for applying a firmly bonded insoluble metal oxide-organic complex on a metal surface by employing the metal as anode and a water-soluble polybasic organic acid as electrolyte. The polybasic acid may be a polyphosphonic acid, polyphosphoric and polycarboxyl acid, or polysulfonic acid and is advantageously polymeric. Polyvinyl phosphonic acid (PVPA) is a preferred electrolyte. Repetitive cycle pulsed direct current is used. The insoluble metal oxide-organic complex formed is composed of anodic oxide combined with polyacid, which forms a protective layer on the metal of improved corrosion resistance. The metal oxide-organic complex is well-suited to bond light sensitive coatings thereto. The metal may be steel, aluminum or magnesium.

39 Claims, No Drawings

NOVEL ELECTROLYTES FOR ELECTROCHEMICALLY TREATED METAL PLATES

CROSS REFERENCE TO RELATED APPLICATION

This application is a continuation-in-part of U.S. patent application Ser. No. 188,092 filed Sept. 26, 1980, now abandoned, which is incorporated herein by reference.

TECHNICAL FIELD

This invention relates to simultaneous anodizing and sealing the surface of metal sheets with novel electrolytes and the products thereby obtained. The resulting anodized and sealed metal sheets have improved corrosion resistance and are suitable, among other uses, for architectural applications. When further used as supports in lithography, particularly if aluminum or its alloys are selected, such sheets exhibit improved adhesion for light sensitive coatings, improved run length, and lessened wear on the press both in image and non-image areas, greater shelf life and improved hydrophilicity in non-image areas. Such anodically generated coatings are more economically obtained than with conventional anodizing.

BACKGROUND OF PRIOR ART

Anodization is an electrolytic process in which the metal is made the anode in a suitable electrolyte. When electric current is passed, the surface of the metal is converted to a form of its oxide having decorative, protective or other properties. The cathode is either a metal or graphite, at which the only important reaction is hydrogen evolution. The metallic anode is consumed and converted to an oxide coating. This coating progresses from the solution side, outward from the metal, so the last-formed oxide is adjacent to the metal. The oxygen required originates from the electrolyte used.

Although anodizing can be used for other metals, aluminum is by far the most important. Magnesium can be anodized by processes similar to those used for aluminum. Zinc can be "anodized" but the process is not truly comparable, depending upon a high voltage discharge that produces a pitted semifused surface. Several other metals, including copper, silver, cadmium, titanium, and steel can be treated anodically for decorative effects.

Anodic oxide coatings on aluminum may be of two main types. One is the so-called barrier layer which forms when the anodizing electrolyte has little capacity for dissolving the oxide. These coatings are essentially nonporous; their thickness is limited to about 13 A/volt applied. Once this limiting thickness is reached, it is an effective barrier to further ionic or electron flow. The current drops to a low leakage value and oxide formation stops. Boric acid and tartaric acid are used as electrolytes for this process.

When the electrolyte has appreciable solvent action on the oxide, the barrier layer does not reach its limiting thickness: current continues to flow, resulting in a "porous" oxide structure. Porous coatings may be quite thick: up to several tens of micrometers, but a thin barrier oxide layer always remains at the metal-oxide interface.

Electron microscope studies show the presence of billions of close-packed cells of amorphous oxide through the oxide layer, generally perpendicular to the metal-oxide interface.

Sulfuric acid is the most widely used electrolyte, with phosphoric also popular. Anodic films of aluminum oxide are harder than air-oxidized surface layers.

Anodizing for decorative, protective and adhesive bonding properties has used strong electrolytes such as sulfuric acid and phosphoric acid. U.S. Pat. No. 2,703,781 employs a mixture of these two electrolytes.

U.S. Pat. No. 3,227,639 uses a mixture of sulfophthalic and sulfuric acids to produce protective and decorative anodic coatings on aluminum. Other aromatic sulfonic acids are used with sulfuric acid in U.S. Pat. No. 3,804,731.

As a post-treatment after anodization, the porous surface is sealed according to numerous processes to determine the final properties of the coating. Pure water at high temperature may be used. It is believed that some oxide is dissolved and reprecipitated as a voluminous hydroxide (or hydrated oxide) inside the pores. Other aqueous sealants contain metal salts whose oxides may be coprecipitated with the aluminum oxide.

U.S. Pat. No. 3,900,370 employs a sealant composition of calcium ions, a water-soluble phosphonic acid which complexes with a divalent metal to protect anodized aluminum or anodized aluminum alloys against corrosion. Polyacrylamide has been proposed as a sealant.

U.S. Pat. No. 3,915,811 adds an organic acid (acetic acid, hydroxy acetic acid, or amino acetic acid) to a mixture of sulfuric and phosphoric acids to form the electrolyte in preparation for electroplating the so-formed anodic aluminum coating.

U.S. Pat. No. 4,115,211 anodizes aluminum by A.C. or superimposed A.C. and D.C. wherein the electrolyte solution contains a water-soluble acid and a water-soluble salt of a heavy metal. The water-soluble acid may be oxalic, tartaric, citric, malonic, sulfuric, phosphoric, sulfamic or boric.

U.S. Pat. No. 3,988,217 employs an electrolyte containing quaternary ammonium salts, or aliphatic amines and a water-soluble thermosetting resin to anodize aluminum for protective, ornamental or corrosion resistant applications.

The advantages of anodized aluminum as a carrier for lithographic printing plates were early recognized. Processes employing as electrolytes sulfuric acid, phosphoric acid, mixtures of these, or either of these in succession have been proposed. Prior to anodizing the sheet may be roughened mechanically or chemically. The need for a subcoating prior to application as a photosensitive layer to impart adhesion to the coating and hydrophilicity to the non-image areas was recognized. U.S. Pat. No. 3,181,461 uses an aqueous alkaline silicate treatment following the anodization step.

U.S. Pat. No. 2,594,289 teaches (Col. 1, lines 42–54) that porous anodic films but not nonporous anodic films are suitable for lithographic purposes, "since the porous film confers a better water receptive surface to the non-image areas of the plate and allows image-forming material to anchor effectively to the surface by penetrating the pores."

U.S. Pat. No. 3,511,661, since disclaimed, describes aluminum sheet for a lithographic printing surface anodized in aqueous phosphoric acid having an anodic film with a cellular pattern of aluminum oxide having cells with porous openings of about 200 Å to 700 Å in average diameter and a surface with 10 to 200 mg per square meter of aluminum phosphate.

U.S. Pat. No. 3,658,662 describes the electrochemical silication of a cleaned, etched aluminum plate to achieve a measure of hydrophilization.

In U.S. Pat. No. 3,902,976 a conventionally anodized aluminum sheet is electrolytically post-treated in an aqueous solution of sodium silicate to form a hydrophilic abrasion-resistant and corrosion-resistant layer suitable as a support for a presensitized lithographic sheet.

U.S. Pat. No. 4,022,670 carries out anodization of aluminum sheets in an aqueous solution of a mixture of polybasic mineral acid such as sulfuric and a higher concentration of a polybasic aromatic sulfonic acid such as sulfophthalic acid to produce a porous anodic oxide surface to which a photosensitive layer may be directly applied.

There is described in U.S. Pat. No. 4,090,880, a two-step process whereby a cleaned aluminum sheet is first coated with an interlayer material such as alkali silicate, Group IV-B metal fluoride, polyacrylic acid, or alkali zirconium fluoride and then anodized conventionally in aqueous sulfuric acid. Enhanced shelf life when overcoated with diazo sensitizers is claimed.

U.S. Pat. No. 4,153,461 employs a post-treatment with aqueous polyvinyl phosphonic acid at temperatures from 40° to 95° C. after conventional anodizing to a thickness of at least 0.2$\mu$. The treatment provides good adhesion of a subsequently applied light sensitive layer, good shelf life and good hydrophilization of non-image areas after exposure and development as well as long press runs.

Plates of the above-construction, particularly when the light sensitive layer is a diazo compound have enjoyed considerable commercial success. Nevertheless, certain improvements would be desirable. These include freedom from occasional coating voids, occasional unpredictable premature image failure on the press, faster, more dependable roll-up on the press and freedom from other inconsistencies. Still greater press life is desirable as well as a process that would be more economical than conventional anodizing followed by a second operation of sealing or post-treating in preparation for coating with a light sensitive layer.

In the case of protective and decorative applications, improved corrosion resistance and production economy over known anodizing processes is desired.

SUMMARY OF THE INVENTION

According to the invention there is provided an electrochemical process for applying a firmly bonded insoluble metal oxide-organic complex on a metal surface by employing the metal as anode and a water-soluble polybasic organic acid as electrolyte. The polybasic acid may be a polyphosphonic acid, polyphosphoric and polycarboxyl acid, or polysulfonic acid and is advantageously polymeric. Polyvinyl phosphonic acid (PVPA) is a preferred electrolyte. Direct current is used. The insoluble metal-organic complex formed is composed of anodic oxide combined with polyacid, which forms a protective layer on the metal of improved corrosion resistance. The metal oxide-organic complex is well-suited to bond light sensitive coatings thereto. When used as a lithographic support the shelf life, lithographic properties and press life are improved over the products of previous processes. The metal may be steel, aluminum or magnesium. The process is economical and the product novel.

Transmission electron microscopy (TEM) of at least 55,000 times magnification of aluminum oxide films obtained according to the invention shows no porosity of the surface of the product of the invention, whereas conventionally anodized aluminum shows typical porosity at as little as 5,000 times magnification. Further, ESCA (Electron Spectroscopy for Chemical Analysis) examination of polyvinyl phosphonic acid treated aluminum shows a high ratio of phosphorus to aluminum (P/Al) in the metal oxide-organic complex surface film. In contrast, conventionally anodized aluminum using even phosphoric acid has a very low P/Al ratio. Conventionally anodized aluminum post-treated by simple thermal immersion in aqueous polyvinyl phosphonic acid (non-electrochemical) has an intermediate, significantly lower P/Al ratio. This is evidence of the incorporation of the electrolyte molecules into the structure of the insoluble metal oxide-organic complex which comprises the surface film of the products of this invention.

Copending application Ser. No. 188,091 filed on Sept. 26, 1980 is concerned with electrolytic pressures wherein mineral acids are used in admixture with the organic electrolyte acids of this invention and with the products so formed which, depending upon the ratios of components employed, have improved corrosion resistance, improved hydrophilicity and non-porous surfaces. Said copending application is explicitly made part of this application by reference.

DETAILED DESCRIPTION OF THE INVENTION AND PREFERRED EMBODIMENTS

The metal substrates to be subjected to electrochemical treatment according to the inventon are first cleaned. Cleaning may be accomplished by a wide range of solvent or aqueous alkaline treatments appropriate to the metal and to the final end-purpose.

Typical alkaline degreasing treatments include: hot aqueous solutions containing alkalis such as sodium hydroxide, potassium hydroxide, trisodium phosphate, sodium silicate, aqueous alkaline and surface active agents. A proprietary composition of this type is Ridolene 57, manufactured by Amchem Products, Pennsylvania. Currently less popular because of environmental and health considerations, is solvent degreasing, using trichloroethylene, 1,1,1-trichloroethane, and perchloroethylene. Solvent degreasing is accomplished by immersion, spray or vapor washing. Included among suitable metals are steel, magnesium, or aluminum or its alloys. Aluminum alloy 1100, 3003 and A-19, product of Consolidated Aluminum Company among others, may be used for lithographic purposes and are preferred. Typical analyses of these three lithographic alloys are shown on a weight percent basis:

| Alloy | Al | Mg | Mn | Fe | Si | Cu |
|---|---|---|---|---|---|---|
| 1100 | 99.2 | — | — | .375 | .375 | .05 |
| 3003 | 99.0 | — | .7 | .15 | .2 | .05 |
| A-19 | 98.3 | .9 | — | .375 | .375 | .05 |

It is surmised that the specific chemical composition of the alloy may have an influence upon the effectiveness of electrodeposition of organic electrolytes. Further other components not usually analyzed may also have an influence.

The metal surface may be smooth or roughened. Conventional surface roughening techniques may be employed. They include but are not restricted to chemical etching in alkaline or acid solutions, graining by dry abrasion with metal brushes, wet abrasion with brushes and slurries of abrasive particles, ball graining and electrochemical graining. The surface roughness and topography varies with each of these processes. For best results according to the practice of this invention, the clean surface should be immediately electrotreated before the formation of an aerial oxide. Prior to immersion of a previously cleaned, degreased and optionally roughened plate in the organic electrolyte solution for electrodeposition, the plate should be etched to remove aerial oxide. Such etching can be accomplished by known etching means including acid and alkaline and electrolytic treatments with the above followed by rinsing. A method for removal of aerial oxide is stripping the plate with a standard etchant such as phosphoric acid/chromic acid solution. Thus immediately after cleaning and roughening (if this step is desired) and etching it is preferable that the metal surface should be rinsed with water and electrotreated while still wet, although useful products may be obtained if this precaution is not rigidly adhered to.

After cleaning and after roughening, if desired, the metal may be optionally anodized conventionally prior to electrodeposition of the organic electrolyte of this invention.

Organic electrolytes which are suitable for improvement of corrosion resistance according to this invention include sulfonic acids, phosphonic acids, phosphoric acids and carboxylic acids which are at least tribasic, both monomeric and polymeric and mixtures of the above. Specific electrolytes include nitrilo triacetic acid 1,2,4,5-benzene tetracarboxylic acid, condensation product of benzene phosphonic acid and formaldehyde (polybenzene phosphonic acid), co-polymers of methylvinyl ether and maleic anhydride at various molecular weights, copolymer of methylvinyl ether and maleic acid, polyvinyl sulfonic acid, polystyrene sulfonic acid, phytic acid, alginic acid, poly-n-butyl benzene sulfonic acid, poly diisopropyl benzene sulfonic acid, polyvinyl phosphonic acid, dodecylpolyoxy ethylene phosphoric acid, tridecyl benzene sulfonic acid, dinonyl naphthalene disulfonic acid-2,2'-dinitro, 4,4'-stilbene disulfonic acid, diisopropyl polynaththalene disulfonic acid, 2-ethylhexyl polyphosphoric acid, dodecyl naphthalene disulfonic acid, di-n-butyl naphthalene disulfonic acid, polydecyl benzene sulfonic acid, polyacrylic acid, polymethacrylic acid, diethylene diamine pentaacetic acid, polynaphthalene sulfonic acid, ethylenediamine tetraacetic acid, hydroxyethyl ethylenediamine triacetic acid, and mixtures of any of the foregoing. All of the above are water-soluble.

For lithographic applications, a high degree of hydrophilicity and firm adhesion of the image is necessary. Preferable electrolytes include the condensation product of benzene phosphonic acid and formaldehyde, lower molecular weight copolymers of methylvinyl ether and maleic anhydride, copolymers of methylvinyl ether and maleic acid, polyvinyl sulfonic acid, phytic acid, polyvinyl phosphonic acid, dodecyl polyoxy ethylene phosphoric acid, diisopropyl polynaphthalene sulfonic acid, 2-ethylhexyl polyphosphoric acid, ethylenediamine tetra acetic acid, hydroxy ethylethylene diamine triacetic acid and mixtures of any of the foregoing.

Most preferred, particularly for critical lithographic applications include the condensation product of benzene phosphonic acid and formaldehyde, phytic acid, polyvinyl phosphonic acid, 2-ethylhexyl polyphosphoric acid and mixtures of any of the foregoing.

Phytic acid mixed with polyvinyl phosphonic acid, for example, provides a very suitable electrolyte mixture.

The concentration of the electrolyte, the electrolysis conditions used, e.g. voltage, current density, time, temperature all play significant roles in determining the properties of the coated metal.

The integrity of the metal oxide-organic complex of which the electrodeposited film is composed may be measured by the potassium zincate test for anodized substrates. This test is described in U.S. Pat. No. 3,940,321. A solution of potassium zincate (ZnO 6.9%, KOH 50.0%, $H_2O$ 43.1%) is applied to the surface of the coating. An untreated plate gives a rapid reaction to form a black film. As a barrier layer is formed, the time for the zincate solution to react is increased. For comparison, an aluminum plate anodized in sulfuric acid to an oxide weight of 3.0 g/$M^2$ will show a reaction in about 30 seconds. A plate anodized in phosphoric acid having an oxide weight of ca. 1.0 g/$M^2$ will take about two minutes to react. Tests with electro-treated plates using polyvinyl phosphonic acid as the electrolyte, consistently take substantially longer to react, unless very low extremes of concentration or operating conditions are used. While it has been found that the zincate test gives clearly recognizable end points for anodic coatings of the prior art, say up to about one minute, the products of this invention produce more difficulty in recognizing end points, particularly as the reaction time increases. The stannous chloride test described below, not only is more rapid, but produces a more easily recognized end point, particularly when observations are conducted under a magnifying lens. Nevertheless, with both reagents, the longer reaction times require some experience for correct interpretation.

U.S. Pat. No. 3,902,976 describes the use of a stannous chloride solution for the same purpose. The end point is a visible hydrogen evolution, followed by a black spot formation. Representative samples tested with zincate and with stannous chloride show the latter to be about 4 times faster. Conventionally anodized aluminum using sulfuric acid and/or phosphoric acid as electrolyte has been used for architectural applications because of superior resistance to weathering. Typical stannous chloride tests for such materials are about 4 to 10 seconds, while for the aluminum sheets of this invention such times are about 15 seconds for a 0.1% solution to more than 200 seconds for a 5% solution. The zincate and stannous chloride tests are believed to correlate with corrosion resistance, a key property in protective and decorative metal applications.

The metal oxide-organic complex film weight is determined quantitatively by stripping with a standard chromic acid/phosphorus acid bath (1.95% $CrO_3$, 3.41% $H_3PO_4$ 85%) balance $H_2O$ at 180° F. for 15 minutes.

The bonding of an electrolytically deposited film is much greater than when prior art thermal immersion is used after anodizing. A 1.0 N NaOH solution removes most of such thermally deposited coating but virtually none of an electrolytically deposited film which is therefore insoluble in reagents of equal or lower aggressiveness.

For lithographic applications, plates are tested after electrodeposition of the metal oxide-organic complex and before coating with a light sensitive layer. The plate is wet or dry inked, the latter test being more severe. After inking, the plate is rinsed under running water or sprayed with water and lightly rubbed. The ease and completeness of ink removal indicates the hydrophilicity of the surface.

Typically, plates prepared in accordance with the invention, when dry inked and baked in an oven at 100° C., rinsed totally free of ink. By contrast, plates either unanodized or conventionally anodized and then subjected to a thermal immersion in an aqueous solution of polyvinyl phosphonic acid are irreversibly scummed when aged even under less severe conditions.

Using the inking tests, plates both with and without photosensitive coatings are aged at various times and temperatures and checked for retention of hydrophilic properties. Plates coated with various diazo coatings were checked by aging for stepwedge consistency, resolution, retention of background hydrophilicity, and ease of development. Suitable light sensitive materials will be discussed below.

Finally, for lithographic applications, plates including controls, are run on press. Differences in topwear, dot sharpening, stepwedge rollback, speed and cleanliness of roll-up, and length of run are observed. In general, in all cases, plates electrodeposited within an extensive range of concentration, time, temperature, voltage, and current density are superior to prior art plates with little criticality in the variables being shown. However, within the confines of the invention, certain variables proved more important than others and certain parameters of those variables were more critical in obtaining best results. This is discussed in more detail below.

The succession of events with increased time in a typical electrodeposition trial may be described. For example, polyvinyl phosphonic acid at 1% concentration is used as a electrolyte at a temperature of 20° C. at 10 volts D.C. with a cleaned and etched aluminum plate as the anode and a carbon rod as the electrode.

The aluminum oxide-organic complex which comprises the surface film forms very rapidly at first. In the first second it is over 140 mg/M$^2$. By the third second it is 250 mg/M$^2$ and in five seconds it is starting to level off at 275 mg/M$^2$. There is no appreciable increase in layer weight up to 300 secs.

During this period the voltage remains substantially constant.

The amperage is not a prime variable but is set by the other conditions selected, particularly the voltage and electrolyte concentration. The amperage begins to decline very shortly after the beginning of electrolysis.

The picture is that of a self-limiting process, in which an electrodeposited barrier layer is formed composed of a metal oxide-organic complex, which restricts the further flow of current. The restriction is not as severe as in the case of boric acid anodization, in which the maximum film thickness is 13–16 Å/volt as found by typical surface analytical technique (i.e., Auger analysis) coupled with ion sputtering.

The stannous chloride test parallels the coating weight gain, up to 250 seconds. There is a rapid increase in reaction time, rising to 150 seconds (corresponding to 630 seconds for a potassium zincate test) which remains constant to an electrodeposition time of 250 seconds, after which there is a small fall-off in stannous chloride reaction time.

At higher voltages, the weight gain is greater. However, the stannous chloride test time, which initially parallels the weight gain rise, falls off much sooner. The explanation is found from transmission electron microscope examination. Whereas the surface is nonporous and featureless up to about 55,000× magnification for treatment times up to the decline in the stannous chloride test reaction time, thereafter it is marked by pits that could be due to arcing. Ink samples confirm this appearance.

It is believed, based upon experiments at various voltages and times, that the metal oxide-organic complex film upon the metal surface acts as a capacitor. As long as the dielectric strength is not exceeded during electrolysis, there is no further weight gain with time, the film is unbroken and the stannous chloride test time remains constant. When the dielectric strength is exceeded, perforation of the film takes place with loss of film integrity. The stannous chloride test time corresponds to this perforation. Although the picture is believed to represent the situation, it is only a speculation and the validity of the invention does not rest upon it. The aforementioned breakdown is primarily a function of voltage with 70 volts the lowest potential at which breakdown takes place quickly. However, even at 30 volts, provided the time is prolonged beyond 250 seconds, in the example cited, some breakdown is observed.

The boundary of breakdown conditions will therefore depend upon the process variables selected. Within this boundary, readily tested by procedures disclosed, there lies the most preferred conditions for the performance of the inventive process and the obtaining of the corresponding products. However, it should be remembered that within a much wider range of conditions which are comparatively non-critical, there are obtained products all of which are improvements over the prior art.

The concentration of electrolyte that may be used ranges from about 0.01% to saturation, but solutions above about 30% are impractical because of viscosity, and does not depend greatly upon its chemical structure. At the lower end, solution conductivity is very low, e.g. 61,000⅓ in the case of polyvinyl phosphonic acid at 0.001%. Nevertheless, even at a concentration of 0.05% a metal oxide-organic complex film is formed which confers properties of corrosion resistance, aging resistance, hydrophilicity and lithographic properties superior to typical products of the prior art such as an aluminum plate conventionally anodized and then thermally sealed in a solution of polyvinyl phosphonic acid as a second step.

Current carrying capacity increases rapidly with concentration, resulting in shorter process times and lower voltage requirements.

There appears to be little difference in the properties of products between 1% and 5% while characteristic properties are still obtained at 30%, despite the high viscosity of the electrolyte. Further, there is a decline in the rate of increase in film thickness at constant voltage with increase in concentration. Based upon considerations of properties obtained, processing ease, film thickness obtained, and cost of electrolyte, a preferred concentration range lies between about 0.8% and about 5%.

There is a reasonably linear relationship between the weight of insoluble metal oxide-organic complex film formed and the direct current voltage employed. In tests with 1% polyvinyl phosphonic acid, at 10 volts (DC), the film weight is about 40 mg. At 110 volts, the film weight is about 860 mg. Figures are found with an electrolysis period of 60 seconds. At all voltages over about 5 volts, the electrodeposited film that is formed confers corrosion resistance and lithographic properties superior to prior art.

As the voltage is raised to 70 volts (DC), the stannous chloride test time increases apparently in response to the increase in film weight and thickness. Beyond 70 volts, the stannous chloride test time decreases, a result believed to be due to the loss in film integrity as the dielectric strength of the film is exceeded and it becomes perforated. This view is confirmed by transmission electron microscopy in which perforation is seen. corrosion resistance is thus favored by operation under 70 volts.

Press tests are longer with plates electrolyzed at lower voltages. In a typical test comparing diazo coated plates electrolyzed at 10, 20 and 40 volts respectively, the order of run length was inversely proportional to the electrolysis voltage and to the metal oxide-organic complex film thickness. The electrodeposition treatment of this invention provides superior sealing of the metal substrate and bonding of the electrodeposited layer to the light sensitive layer overall. The printing trial results show that lower voltages favor better bonding to the light sensitive layer, particularly diazo based layers, with the range from between about 10 volts to about 30 volts preferred. Direct current is required for the process, although alternating current may be superimposed. Square waves from the pulse plating sources are particularly useful.

Amperage is at a maximum at the beginning of electrodeposition and declines with time as the metal oxide-organic complex film builds upon the metal surface and reduces current carrying capacity. Within 30 seconds it has declined to a level at which further current consumption becomes minimal. This is a major factor in processing economy, as a useful, desirable film has already been deposited.

Using as electrolyte a 1% solution of polyvinyl phosphonic acid depending upon the impressed voltage and specimen geometry, the amperage surged to about 10 amps/dm$^2$ and then declined to about 120 milliamps/dm$^2$. This decine to very low current levels is characteristic of the process using the organic electrolytes of this invention. By contrast, in normal anodizing using strong electrolytes above, the current drops slowly and remains at levels around 10 to 15 amperes for the balance of the process.

Amperage is thus a dependent variable, with electrolyte identity, concentration and voltage the independent variables. Current densities of from about 1.3 amps/dm$^2$ to about 4.3 amps/dm$^2$ are characteristic of favorable process operating conditions and are preferred.

The temperatures at which the process is conducted may range from about $-2°$ C. (near the freezing point of the electrolyte) to about 60° C. Best results based on tests of surface hardness, stannous chloride test times, image adhesion, hydrophilicity, and aging characteristics are obtained at 10° C. However, decrease in performance from 10° C. to room temperature and even up to 40° C. is not very great. Operation at very low temperatures would require expensive cooling capacity. Accordingly, a temperature range between about 10° C. and 35° C. is preferred and an operating temperature of about 20° C. to about 25° C. is still further preferred because of operating economy and minimal loss of performance.

Over 60% of the metal oxide-organic complex film is produced within the first five seconds (0.8 minutes) of electrodeposition. Times beyond five minutes are not beneficial for litho uses as no further film is produced but are not harmful as long as voltage is low as discussed above. A time range of between about 0.16 minutes and about 1 minute is preferred From a process point of view the short time, low temperature (room temperature with little need for auxiliary heating or cooling) and low current consumption are all favorable economic factors compared to conventional anodizing followed by thermal substrate treatments characteristic of prior art processes.

As an alternative to the use of continuous direct current, which has just been discussed, a pulsed plating variant may also be used. Pulsed plating, as used herein, refers to the use of pulsed rectified square wave current sources in electrolytic processes wherein the potential of the pulse may be varied and the time-off/time-on ratio may be taken from 1000:1 to 1:1000. This is contrast to conventional plating techniques, wherein the electrical potential is applied continuously for the duration of the actual electrodeposition operation. The electrolyte and the sheet materials used are the same. Benefits are found in the increased length of run obtained with pulsed plating compared to the use of continuous plating sources and in reduced current consumption to obtain the desired results.

There are several forms of current, rectified or non-rectified that may be advantageously employed. They are:

(1) Square wave AC
(2) Assymetrical square wave AC or square wave DC with fractional reverse potential
(3) Rectified square wave
(4) Assymetrical sine wave
(5) Saw tooth-assymetrical Any suitable pulse plating unit may be used. There are several available on the market. One in particular was used in the applications of this invention and named in the Examples. Addition information descriptive of pulse plating is given in Metal Finishing for December 1979. "Pulse Plating—Retrospects and Prospects" by Berger and Robinson, CSIRO, Production Technology Laboratory, Melbourne, Australia.

In general, the use of pulsed plating improved run length regardless of cycle used. However, the longest runs were obtained when the time for potential on exceeded the time for potential off.

Useful cycles run from 100$\mu$ seconds to 1.0 second for time off and time on, each considered independently.

Light sensitive compositions suitable for preparation of printing forms by coating upon the metal oxide-organic complex films of this invention include iminoquinone diazides, o-quinone diazides, and condensation products of aromatic diazonium compounds together with appropriate binders. Such sensitizers are described in U.S. Pat. Nos. 3,175,906; 3,046,118; 2,063,631; 2,667,415; 3,867,147 with the compositions in the last being in general preferred. Further suitable are photopolymer systems based upon ethylenically unsaturated monomers with photoinitiators which may include matrix polymer binders. Also suitable are photodimerization systems such as polyvinyl cinnamates and those based upon diallyl phthalate prepolymers. Such systems are described in U.S. Pat. Nos. 3,497,356; 3,615,435; 3,926,643; 2,670,286; 3,376,138 and 3,376,139.

It is to be emphasized that the aforementioned specific light sensitive systems which may be employed in the present invention are conventional in the art. Although all compositions are useful, the diazos are generally preferred as they tend to adhere best to the metal oxide-organic complex and to exhibit higher resolution in printing.

The physical appearance of the surfaces of electrodeposited coatings of organic electrolytes of this invention has been examined by transmission electron microscopy. When viewed at magnifications of at least 55,000×, a nonporous surface is seen. In contrast, conventionally anodized surfaces show typical pores at as little as 5,000 magnification. Accordingly, when the term "nonporous" is used herein, it is meant that pores are not visible at 55,000× magnification using transmission electron microscopy.

Physical-chemical analysis by ESCA (Electron Spectroscopy for Chemical Analysis) has been described above and shows that the electrolyte is tightly bonded with metal oxide to the surface of the metal surface to form an insoluble metal-organic complex.

ESCA results with phosphonic acid treated aluminum shows phosphorous/aluminum ratios of 0.6–0.9:1 for thermal treatment versus 1.10 to 2.54:1, (average=1.54) when electrolytically treated.

A third form of analysis uses the Auger technique to determine the thickness of the layer formed on the surface of the metal by electrochemical action. The thickness of layers of constant composition can be measured and compared for the different electrochemical processes. As the voltage used in each process is known, results can be stated in A/volt.

Typical barrier layers using boric and tartaric acids have thicknesses of 13 Å–16 Å/volt and are nonporous.

Conventionally anodized aluminum using sulfuric acid or phosphoric have thicknesses of 100–150 A/volt and are porous as determined by TEM.

Aluminum electrolyzed in a 1% solution of polyvinyl phosphonic acid (typical electrolyte of this invention) develops a coating of 50 Å/volt to 30 Å/volt at 10 and 30 volts respectively, and is nonporous. It must be remembered that the coating develops very rapidly and does not increase in thickness with further increase in electrolysis time. Thus the products of this invention are nonporous, having coating thicknesses of 30 to 50 A/volt and at least when phosphonic acids are used as electrolyte, additionally have high phosphorus to aluminum ratios showing the incorporation of molecules of the electrolyte together with metal oxide in the insoluble metal oxide-organic complex of which the electrodeposited coating is composed.

EXAMPLE 1

Several sections of 3003 alloy aluminum (17.75 cm×19.00 cm×0.05 cm) were prepared for electrotreatment by degreasing both sides with Ridoline 57, Amchem Products, an inhibited alkaline degreaser.

The degreased section of aluminum was then etched with a 1.0 N NaOH solution at room temperature for 20 seconds.

After etching, the aluminum plate was thoroughly water rinsed and immediately placed in an electrically insulated tank containing a 1.0% solution of polyvinyl phosphonic acid (PVPA). On each side of the aluminum were placed lead electrodes with dimensions corresponding to the aluminum plate. The electrodes were equidistant from the aluminum with a gap of 10 cm.

Using a D.C. output, the aluminum was made anodic and the lead electrodes were made cathodic. The temperature of the bath was maintained at 25° C. The current was turned on with the voltage present to 60 VDC. The process was allowed to run for 30 seconds. The EMF was turned off, the plate removed from the bath and rinsed well. The plate was then blotted dry.

Several drops of saturated solution of stannous chloride were placed upon the surface. The stannous chloride reacts with the aluminum once it has migrated through the layer generated by the electrochemical process. Discrete black spots of metallic tin signal the end of the test.

The surface produced as described required 182 seconds for the $SnCl_2$ to totally migrate through the electrodeposited surface film. The aluminum oxide-organic complex surface film weight was 648 mg/M$^2$ as determined by stripping with chromic acid/phosphoric acid solution. Hydrophilicity of the surface was tested by applying a heavy rub-up ink without the benefit of any water. A dry applicator pad was used.

The plate was perfectly clean when immediately dry inked and water washed. Additional pieces of the plate were aged at room temperature for seven calendar days, at 50° C. for seven calendar days and at 100° C. for one hour. After aging, the plates were dry inked and rinsed. In all cases the plates rinsed ink-free.

Finally, the plate was coated with a solution containing a pigment, polyvinyl formal binder and a diazonium condensation product of U.S. Pat. No. 3,867,147. When exposed through a standard negative flat and developed with an aqueous alcohol developer, the background cleared easily leaving an intense image that under magnification was considered very good. It was not necessary to dampen the plate prior to inking to prevent scumming.

Using a 21-step Stouffer step wedge, exposure was made to give a solid six after development with an aqueous alcohol developer.

EXAMPLES 2 THROUGH 30

In like manner as described in Example 1, the electrolytes tabulated below were substituted for PVPA and subsequently processed. After preparation, in the manner described in Example 1, the metal oxide-organic complex film weight, stannate test time and ink test response were determined for each plate prepared. The results are tabulated below.

| Example | Acid | Time (Secs.) $SnCl_2$ | Film Wt. mg/M$^2$ | Ink Test |
|---|---|---|---|---|
| 2 | Nitrilo triacetic acid | 45 | 87 | T |
| 3 | 1,2,4,5-Benzene tetracarboxylic acid | 37 | 94 | S |

-continued

| Example | Acid | Time (Secs.) $SnCl_2$ | Film Wt. $mg/M^2$ | Ink Test |
|---|---|---|---|---|
| 4 | Poly benzene phosphonic acid | 87 | 138 | C |
| 5 | Gantrez AN-119® GAF Corp., (low viscosity) polyvinyl methyl ether maleic anhydride | 91 | 142 | C |
| 6 | Gantrez AN-139® GAF Corp., (medium viscosity) polyvinyl methyl ether maleic anhydride | 73 | 127 | C |
| 7 | Gantrez AN-169® GAF Corp., (high viscosity) polyvinyl methyl ether maleic anhydride | 57 | 118 | T |
| 8 | Gantrez AN-179® GAF Corp., (high viscosity) polyvinyl methyl ether maleic anhydride | 53 | 107 | T |
| 9 | Gantrez S-95® GAF Corp. (polyvinyl methyl ether maleic acid) | 102 | 149 | C |
| 10 | polyvinyl sulfonic acid | 90 | 191 | CT |
| 11 | polystyrene sulfonic acid | 106 | 197 | S |
| 12 | myoinositol hexaphosphoric acid (phytic acid) | 113 | 208 | C |
| 13 | alginic acid | 39 | 85 | S |
| 14 | poly n-butyl benzene sulfonic acid | 36 | 213 | S |
| 15 | poly di-isopropyl benzene sulfonic acid | 48 | 217 | S |
| 16 | dodecyl polyoxyethylene phosphoric acid | 29 | 179 | C |
| 17 | tridecyl benzene sulfonic acid | 61 | 232 | S |
| 18 | dinonyl naphthalene disulfonic acid | 47 | 222 | T |
| 19 | 2,2-dinitro-4,4-disulfonic acid stilbene | 53 | 237 | CT |
| 20 | diisopropyl polynaphthalene sulfonic acid | 44 | 206 | S |
| 21 | 2-ethyl hexyl polyphosphoric acid | 118 | 192 | C |
| 22 | dodecyl naphthalene disulfonic acid | 52 | 211 | T |
| 23 | di-n-butyl naphthalene disulfonic acid | 46 | 217 | T |
| 24 | polydecyl benzene sulfonic acid | 61 | 220 | S |
| 25 | polyacrylic acid | 43 | 102 | CT |
| 26 | polymethacrylic acid | 37 | 93 | T |
| 27 | diethylene diamine pentaacetic acid | 42 | 157 | T |
| 28 | polynaphthalene sulfonic acid | 35 | 181 | T |
| 29 | ethylene diamine tetraacetic acid | 43 | 162 | CT |
| 30 | hydroxy ethylene diamine triacetic acid | 46 | 150 | C |

C = Rinsed totally clean, suitable for critical litho applications
T = Slightly toned or peppered
S = Scummed, unsuitable for litho
CT = Intermediate between C and T

EXAMPLE 31

A plate was prepared in like manner, as described in Example 1. In this case the electrolyte was phosphoric acid added to the extent of 75 g/l. The voltage was dropped to 30 VDC because of the tremendous current flow that would occur at 60 VDC. the time was increased from 30 to 60 seconds. After processing, the plate was rinsed and blotted dry.

The plate was found to have an oxide weight of 871 $mg/M^2$. The stannous chloride reaction time was 8 seconds. The result of dry inking the surface was a scummed plate. The application of a light sensitive coating and subsequent exposure, development and inking gave a scummed plate.

EXAMPLE 32

A plate was prepared as described in Example 31 except that after removal from the electrotreating bath the plate was rinsed and immersed in a bath of 0.2% PVPA in tap water at a temperature of 150° F. for 30 secs. After treatment, the plate was rinsed and blotted dry.

The plate was found to have an oxide complex weight of 909 $mg/M^2$. The stannous chloride reaction time was 10 seconds. Upon dry inking the plate, it was not possible to totally remove the ink. That which was removable required considerble effort. Upon coating the substrate with a light sensitive solution, previously described, and exposing, developing and inking, it was found that the plate was acceptable only if the background was dampened before inking.

EXAMPLE 33

A plate was degreased and etched as described in Example 1. Instead of electrodepositing with PVPA, the etched plate was immersed in a bath of 0.2% PVPA maintained at a temperature of 150° F. (65.5° C.), (thermally treated). It was allowed to remain immersed for 60 seconds at which point it was removed, rinsed and blotted dry.

The stannous chloride test gave an immediate reaction (<1 second). Stripping the film gave a weight of 37 $mg/M^2$. On a freshly made plate, dry ink wiped clean with relative ease. With aging as described in Example 1, it was found that this surface became increasingly difficult to wipe clean when inked. Within the period of one week, the surface irreversibly scummed when ink tested.

A light sensitive coating as described in U.S. Pat. No. 3,867,147, was applied to the plate, exposed, developed and inked. When wet inked, the background was acceptable. Dry inking resulted in a background that left some ink hanging after rinsing.

EXAMPLE 34

A plate was cleaned and etched as described in Example 1. It was immediately placed in an electrically insulated bath containing 150 g/l of $H_2SO_4$ (96%). The plate was made anodic and was processed with 18 VDC for 60 seconds. The voltage was kept constant. The temperature of the bath was maintained at 40° C. The plate processed in this fashion was taken from the bath and well rinsed and blotted dry. The oxide complex weight was 3213 mg/M$^2$.

The time necessary for the stannous chloride t react was only four seconds. Dry inking of a freshly prepared surface resulted in an irreversibly scummed plate. Aging was therefore not attempted.

The plate was also coated with negative light sensitive coating as in Example 1, exposed, developed and inked. Both wet inked and dry inked samples showed scummed backgrounds.

EXAMPLE 35

A plate was prepared exactly as described in Example 34 except, that as an additional step, the plate was thermally treated with a 0.2% solution of PVPA at 150° F. (65.5° C.) for 60 seconds. This step was conducted immediately after the plate was anodized and rinsed. After thermal processing with PVPA, the plate was well rinsed and blotted dry.

Using the stripping method described in Example 1, the plate was found to have a film weight of 3267 mg/M$^2$. The stannous chloride reaction time was low at 6 seconds. Dry inking of a freshly produced plate permitted ink removal with reasonable ease. Under aging conditions described in Example 2, the ink would remain in spots after 24 hours. In 48 hours, the surface was unacceptable in that ink could not be removed.

Application of a negative light sensitive coating, as in Example 1, on a freshly produced surface permitted acceptable imaging and development. After aging, as in Example 1, the background was found to invariably scum.

EXAMPLE 36

A plate was cleaned and etched as described in Example 1. A tank was charged with sodium silicate having a sodium oxide/silicon dioxide ratio of 2.5:1 to a final concentration of 7.0% (w/w). The solution was heated to and maintained at 180° F. (82.2° C.). The plate was next immersed into this solution for 60 seconds. After that time the plate was removed and thoroughly rinsed immediately. After the water rinse, the plate was immersed into a 1.0% $H_3PO_4$ (85%) solution 30 at room temperature for 30 seconds. Upon removal, the plate was water rinsed and blotted dry.

The stannous chloride reaction time was 10 seconds. Wet and dry inking of the freshly prepared plate was acceptable in that all of the ink was easily removed. Plates aged at 50° C. for one week and 100° C. for one hour showed failure in the dry inking test. Plates freshly made and coated with a negative coating solution, as in Example 1, were acceptable after exposing, developing and inking the plate. When the plate was aged and then coated, or coated and then aged, after 7 days at 50° C. and 4 weeks at room temperature, the background was unacceptable, after dry inking.

EXAMPLE 37

A plate was prepared as described in Example 36 except that the silication was electrochemical instead of thermal. The plate in the hot sodium silicate solution was made anodic. A potential of 30 VDC was applied for 30 seconds and then water rinsed. An immersion into a 3.0% (w/w) solution of $H_3PO_4$ (85%) immediately followed. Water rinsing was once more conducted, with the plate then being blotted dry. This corresponds to the practice of U.S. Pat. No. 3,658,662.

The stannous chloride reaction time was increased to 46 seconds. Dry inking of a freshly produced plate permitted easy removal of ink. Plates aged at room temperature lost hydrophilicity, shown as toning after eight weeks when applying the dry ink test. At 50° C., the plates showed toning when dry inked after fifteen days aging.

Plates coated, developed and inked, as in Example 1, when fresh were acceptable as judged by the background. Plates coated with a negative solution of light sensitive material were considered to be lithographically non-usable at 18 weeks at room temperature and 22 days at 50° C.

EXAMPLE 38

A plate was degreased and etched as in Example 1. The plate was then anodized in a solution of $H_3PO_4$ (85%) added in the amount of 75 g/l. The voltage used was 30 VDC, applied for 60 seconds.

Immediately after anodizing, the surface was well rinsed and silicated thermally as described in Example 36.

All testing gave essentially the same results as those obtained with the plate of Example 36 (simple thermal silication). The stannous chloride test reaction time was 9 seconds. At 50° C., the dry ink test showed failure at seven days and one hour respectively. Coated plates failed after 30 days at room temperature and seven days at 50° C. The only benefit to anodizing prior to thermal silication was observed in an increased number of impressions in printing trials.

EXAMPLE 39

A plate was anodized according to the procedure of Example 34 and then electrochemically silicated in a 7.0% solution of sodium silicate heated to 180° F. (82.2° C.). An EMF of 30 VDC was used for 60 seconds. This corresponds to the practices of U.S. Pat No. 3,902,976.

The stannous chloride reaction time was 55 seconds. Dry inking of a freshly produced plate gave a clean surface that rinsed free quickly and easily. Plates aged at room temperature toned when dry inked after ten weeks. At 50° C. the plates toned at 19 days. Plates freshly made were coated with a solution containing negative light sensitive material as in Example 1. When aged at room temperature, the plates were rated as non-usable after 19 weeks and at 50° C., loss of quality occurred at 22 days. Again, the benefit of post-treating an anodized plate by electrosilicating was not so much the improvement of hydrophilicity, as increasing the length of run. See Example 38.

EXAMPLE 40

After degreasing and etching as in Example 1, a section of magnesium was immersed in a solution of 1.0% PVPA at room temperature. A potential of 60 VDC was applied across the solution where the Mg was made anodic and the lead electrodes were cathodic. The treatment lasted 60 seconds after which the metal section was rinsed and blotted dry. The stannous chloride reaction time was 213 seconds. The surface was dry inked and compared to magnesium that was untreated and magnesium that was reacted thermally with PVPA (0.2%@150° F. for 60 seconds).

When the magnesium treated with electrodeposited PVPA was dry inked, it rinsed totally free of ink with great ease. The two controls, however, were badly scummed. Further, the controls were tested for reactivity with stannous chloride. The untreated piece reacted immediately (<1 second) and the thermally treated piece took approximately 2 seconds. A negative working light sensitive coating was applied, exposed, developed and inked. The background was clean. The image adhered well and had good resolution.

EXAMPLE 41

A small section of mild steel was degreased and activated by etching with a 1.0% (w/w) solutio of $HNO_3$ for 60 seconds at room temperture. After etching, the work piece was thoroughly rinsed with water and immediately placed into a solution containing 1.0% (w/w) of PVPA. At ambient temperature, the work piece had applied to it a potential of 30 VDC for 30 seconds. fterwards, the sheet ws removed, rinsed and blotted dry.

As the electrical potential of $Fe(s) \rightarrow Fe^{+2} + 2e$-is below that of $Sn^{2+} + 2e \rightarrow Sn(s)$, stannous chloride could not be used to ascertain the improvement in resistance of the generated film. Therefore, only the dry inking and the application of a light sensitive coating was attempted.

Dry inking the above plate showed a surface having much improved hydrophilicity in that all the ink was removed easily. When preparing a sheet of iron as a control, a 0.2% (w/w) PVPA solution at 150° F. was used to treat the metal for 60 seconds. Here, there was no change in hydrophilicity over untreated iron.

The light sensitive coating described in Example 1 was applied to the electrochemically prepared sheet as well as the thermally prepared control. The sheets were then exposed, developed and inked. The benefit of electrochemical processing was shown: The image on the control plate was lost in the developing process. Further, ink adhered to the background. The electrochemically produced plate displayed an image firmly anchored to the substrate and exhibited good resolution. Inking the plate gave a clean background.

EXAMPLES 42 TO 51

Mixtures of organic electrolytes were made to a total concentration of 1.0%. The mixture was used as electrolyte. Electrolysis was conducted at 30 VDC, for 30 seconds at room temperature on aluminum sheets previously degreased, slurry grained and etched as in Example 53. The compositions, aluminum oxide-organic film weights, stannous chloride reaction times and behavior in the dry inking test are shown in the following table. In all cases corrosion resistance and hydrophilicity were high.

| | | | Co-electrolyte System | | | | |
|---|---|---|---|---|---|---|---|
| Example | Electrolyte | % (w/w) | Co-electrolyte | % (w/w) | $mg/M^2$ | $SnCl_2$ Test. Secs. | Hydrophilicity |
| 42 | PVPA | 0.5 | polyvinyl methyl ether/maleic anhydride | 0.5 | 369 | 117 | C |
| 43 | Hydroxy ethyl ED Tri A | 0.75 | polystyrene sulfonic acid | 0.25 | 440 | 107 | CT |
| 44 | polystyrene sulfonic acid | 0.25 | PVPA | 0.75 | 410 | 110 | C |
| 45 | PVPA | 0.5 | phytic acid | 0.5 | 392 | 123 | C |
| 46 | PVPA | 0.75 | phytic acid | 0.25 | 378 | 131 | C |
| 47 | EDTA | 0.75 | PVPA | 0.25 | 401 | 112 | C |
| 48 | phytic acid | 0.5 | polyvinyl methyl ether/maleic anhydride | 0.5 | 388 | 125 | C |
| 49 | polystyrene sulfonic acid | 0.5 | phytic acid | 0.5 | 411 | 98 | CT |
| 50 | polybenzene phosphonic acid | 0.75 | PVPA | 0.25 | 377 | 108 | C |
| 51 | polyacrylic acid | 0.75 | PVPA | 0.25 | 358 | 134 | C |

C = Rinsed totally clean, suitable for critical litho applications
T = Slightly toned or peppered

EXAMPLE 52

A section of 3003 aluminum was degreased as described in Example 1. The surface was mechanically roughened by using the combined abrading action of a quartz slurry and rotating nylon brushes. After roughening, the aluminum was thoroughly washed to remove all quartz particles. After water washing and before the aluminum could dry, it was immersed into a 0.2% (w/w) solution of PVPA heated to a temperature of 150° F. (65.5° C.). The time of treatment was 60 seconds after which the web was water washed and dried.

The sample produced in the described manner was found to have a film weighing 37 $mg/M^2$ and a resistance to stannous chloride of 6 seconds.

On the freshly prepared plate, the dry ink test indicated a hydrophilic surface in that the ink could be removed with light rubbing. A plate aged at room temperature for seven days was partly scummed when dry inked and totally scummed after aging for ten days when dry inked.

When the substrate was coated with a light sensitive negative coating and aged with the various times and temperatures as in Example 1, the background was unacceptable in that is was irreversible scummed.

EXAMPLE 53

A plate was processed as described in Example 52 except that the plate was electrochemically processed in a 1.0% (w/w) solution at room temperature using 30 VDC for 30 seconds. After the current ceased flowing, the plate was rinsed and blotted dry.

The stannous chloride rection time was 122 seconds. A film weight of 395 $mg/M^2$ was measured using the chromic acid/phosphoric acid procedure.

The dry inking test conducted as described in Example 1 gave extremely good results in that no test failed. Coating with the negative coating solution also described in Example 1, and subsequently exposing, developing and inking provided a plate having a totally clean background along with a well attached image processing high resolution.

EXAMPLE 54

Substituting aluminum 1100 alloy for the 3003 alloy, the procedure was repeated exactly as stated in Example 53. The results in terms of stannous chloride reaction time, film weight, dry ink test, aging and coating tests were identical. There was an improvement in all characteristics when compared to the control of Example 52.

EXAMPLE 55

A section of 3003 aluminum alloy ws degreased and dried. The sheet was then mechanically roughened using a dry method that utilizes a rotating brush made of steel bristles (wire brushing). After the roughening the sheet was etched to activate the surface, rinsed and immersed into an electrically isolated bath containing a 1.0% (w/w) solutio of PVPA. A potential of 30 VDC was applied through the solution to the plate for 30 seconds. The plate was then rinsed and blotted dry.

The electrically generated surface had a stannous chloride resistance time of 127 seconds. The weight of the electrically generated film was 415 mg/M$^2$.

Using the aging techniques for dry inking that are described in Example 1, the surface was shown to possess good hydrophilicity that was retained with time.

Coating with a light sensitive negative coating composition as described in Example 1, the electrodeposition of PVA on a wire brushed surface showed an improvement over the thermally treated control (0.2% sol PVPA@150° F. for 60 sec.) in that the resolution, developer resistance and adhesion of the image was improved. Further, the background was considerably more hydrophilic than the control.

EXAMPLE 56

A degreased sheet of 1100 alloy aluminum was electrochemically grained and rinsed with water. It was immediately placed into a 0.1% PVPA solution and electrodeposited at room teperature with a potential of 30 VDC for 30 seconds. After treatment, the plate was rinsed and blotted dry.

The surface formed had a stannous chloride resistance time of 103 seconds and a weight of 396 mg/M$^2$. Dry inked, a freshly prepared plate rinsed free of ink. Using the aging test described in Example 1 for dry ink tests, the surface generated on an electrochemically grained substrate was satisfactory in all cases.

Further, the application of a negative light sensitive coating as in Example 1, was an improvement over an electrochemically grained substrate thermally reacted with PVPA. Adhesion was better as well as resistance to developer.

EXAMPLE 57

A section of aluminum alloy 1100 was etched and electrochemically grained. The plate was subsequently rinsed and placed into a bath containing 150 g/l of $H_2SO_4$ (96%). By applying an electric potential of 18 VDC across the solution for 60 seconds, the aluminum by virtue of being anodic was electrically oxidized. This plate was then rinsed well with water and placed into a bath containing a 1.0% (w/w) solution of PVPA. At room temperature, a potential of 30 VDC was applied for 30 seconds. This surface was compared to a plate prepared in the same fashion except that a thermal PVPA (0.2%@150° F. for 60 sec.) was administered rather than electrical. The control had a film weight of 2876 mg/M$^2$ and a stannous chloride resistance time of 8 seconds. The test plate made with the electrotreatment of PVPA had a film weight of 2919 mg/M$^2$ with the stannous chloride resistance time increased to 114 seconds.

The dry inking of both plates freshly prepared was acceptable. However, the control plate displayed a loss of hydrophilicity in a short period of time, (<4 days at R.T., 1 day at 50° C. and 30 min@100° C.).

When coated, the PVPA electrically treated plate gave better image adhesion and developer resistance than did the control.

EXAMPLE 58

Sheets of 1100 alloy, 3003 alloy and A-19 alloy (manufactured by Consolidated Aluminum Co., St. Louis, Mo.) were hand grained in a wet fashion using quartz slurry and a nylon scrub brush. With a light-sectioning microscope, all three were found to have the same average depth of grain (i.e., 2.25±0.2μ). They were then processed with PVPA in accordance with Example 53.

The plates were then coated to the same coating weight with a negative coating solution described in Example 1. They were subsequently exposed, developed and finished. The plates were run to breakdown on a sheet-fed press. Under abrasive conditions having a wear factor of 2.5, the A-19 plate ran 45,000 impressions befor image failure occurred. The 3003 plate ran 36,000 impressions with the 1100 alloy lasting 29,000 impressions.

A control plate using 3003 alloy that was thermally treated with PVPA as described in Example 52, but otherwise processed the same as the above test plates, failed at 17,000 impressions.

EXAMPLE 59

Several plates were made exactly as decsribed in Example 53. These were to serve as the substrate for several coating solutions. Serving as a control were plates made as described in Example 52 in which PVPA was thermally applied from solution.

Coating #1 was a photo dimerizable coating that is first described in U.S. Pat. No. 2,670,286.

Coating #2 was photo crosslinking non-diazo coating based upon the free radical initiation of polyfunctional acrylic resins. This composition is disclosed in U.S. Pat. No. 3,615,435.

Coating #3, a non-diazo containing photo polymerizable coating which is disclosed in U.S. Pat. No. 4,161,588.

Coating #4 is a positive working (photo solubilizable) coating based upon diazo naphthol sulfo esters. Such a coating is described in U.S. Pat. No. 3,046,118.

Coatings 1, 2 and 3 are applied to control and test plates alike, and are exposed with a negative exposure flat using a conventional metal halogen exposure frame and an equal number of light integration units. The plates were developed using a prescribed processing solution detailed in the respective patent. All plates are then inked and compared.

The images on the control plates all were less intense than the corresponding image on the test plates with the step-wedge reading (21-step Stouffer Scale) being two steps lower in all cases. The highlight areas on the control plate were lost; whereas on the electrodeposited plates, all highlight areas were retained. Further, the control plates had toning in the background. The PVPA electrotreated plates were all clean.

The positive coating referred to above was coated on both test and control plates. Using a positive exposure flat, exposure was made so as to give a knock-out 2 on the 21-step Stouffer Scale after development with a standard alkaline developer.

The control plate had a knock-out 2 with 10 ghost steps. The electrochemically PVPA treated plate had a knock-out 2 and 14 ghost steps. Further, the highlights were lost on the control and retained on the other.

EXAMPLES 60 TO 68

The procedure of Example 53 was used except that the concentration of polyvinyl phosphonic acid was 0.01% and the tests were conducted at room temperature. Electrodeposition periods of 10, 60 and 300 seconds were used at each of 5, 30 and 90 VDC. Stannous chloride tests were run and aluminum oxide-organic complex surface film weights determined by the standard procedure. These data are recorded in Table 1.

TABLE 1

| Time | 0.01% PVPA @ R.T. | | | | | |
|---|---|---|---|---|---|---|
| | 5 VDC | | 30 VDC | | 90 VDC | |
| (Seconds) | g/M² | $SnCl_2$ | g/M² | $SnCl_2$ | g/M² | $SnCl_2$ |
| 10 | 0.016 | 2 | 0.021 | 4 | 0.027 | 6 |
| 60 | 0.024 | 3 | 0.023 | 5 | 0.035 | 17 |
| 300 | 0.031 | 4 | 0.031 | 8 | 0.037 | 41 |

Each of the plates prepared according to the conditions given in Table 1 above were tested for hydrophilicity by dry inking and aging and then by dry inking by procedure of Example 1, and compared with control plates prepared according to Examples 33 and 35. In all cases the plates prepared according to these examples rinsed totally free of ink where the controls either did not rinse completely clean or required rubbing to free them of ink. Thus coatings of the kind produced by this invention, have superior hydrophilicity even when the coating weight is as low as 0.016 g/M² (10 secs., 5 VDC).

A coating of 0.008 g/M², produced at 5 VDC in one second, not shown in the above tabulation had equally good hydrophilicity by the same test. For corrosion resistance the electrolyte concentration is somewhat low to roduce good corrosion resistance.

EXAMPLES 69 TO 77

The procedure of Examples 59 to 67 was followed except that the electrolyte concentration was rasied to 0.1%. The results are shown in Table 2. It can be seen that at either longer electrodeposition times or increased voltage, at this concentration, corrosion resistance is increased. As before in Examples 59 to 67, all coatings showed a high degree of hydrophilicity by the dry inking and aging tests when compared to the control plates, Examples 33 and 35.

TABLE 2

| Time | 0.1% PVPA @ R.T. | | | | | |
|---|---|---|---|---|---|---|
| | 5 VDC | | 30 VDC | | 90 VDC | |
| (Seconds) | g/M² | $SnCl_2$ | g/M² | $SnCl_2$ | g/M² | $SnCl_2$ |
| 10 | 0.043 | 11 | 0.110 | 12 | 0.157 | 24 |
| 60 | 0.050 | 14 | 0.163 | 18 | 0.202 | 49 |
| 300 | 0.051 | 14 | 0.198 | 18 | 0.222 | 44 |

EXAMPLES 78 TO 106

The procedure of Examples 59 to 67 was followed, except that the electrolyte concentration was 1.0%. I addition, plates were electrotreated at 20, 40 and 80 seconds at 30 and 60 volts D.C. These results are inincluded in Table 3 below in their logical places to show stannous chloride reaction time. Moreover, each of the plates prepared at 20, 40 and 80 seconds were used as carriers for press tests. The procedure for plate preparation and results are given in Table 3.

TABLE 3

| Time | 1.0% PVPA @ R.T. | | | | | | | |
|---|---|---|---|---|---|---|---|---|
| | 5 VDC | | 30 VDC | | 60 VDC | | 90 VDC | |
| (Seconds) | g/M² | $SnCl_2$ | g/M² | $SnCl_2$ | g/M² | $SnCl_2$ | g/M² | $SnCl_2$ |
| 1 | 0.043 | 7 | 0.217 | 26 | 0.398 | 73 | 0.547 | 136 |
| 5 | | | 0.271 | 31 | 0.461 | 98 | | |
| 10 | 0.083 | 19 | 0.373 | 85 | 0.592 | 120 | 0.782 | 165 |
| 20 | | | 0.385 | 103 | 0.620 | 134 | | |
| 30 | 0.088 | 21 | 0.396 | 122 | 0.648 | 148 | 0.861 | 173 |
| 40 | | | 0.414 | 125 | 0.654 | 164 | | |
| 60 | 0.093 | 20 | 0.431 | 128 | 0.661 | 180 | 0.873 | 190 |
| 80 | | | 0.430 | 129 | 0.694 | 208 | | |
| 120 | | | 0.430 | 130 | 0.724 | 237 | | |
| 300 | | | 0.431 | 91 | 0.758 | 191 | 0.902 | 213 |

As before, as in Examples 59 to 67, all plates shown in Table 3, were highly hydrophilic in dry inking and aging tests.

EXAMPLES 107 to 115

The procedure of Examples 59 to 67 was used except that the electrolyte concentration was 5.0%. The results are recorded in Table 4.

TABLE 4

| Time | 5.0% PVPA @ R.T. | | | | | |
|---|---|---|---|---|---|---|
| | 5 VDC | | 30 VDC | | 90 VDC | |
| (Seconds) | g/M² | $SnCl_2$ | g/M² | $SnCl_2$ | g/M² | $SnCl_2$ |
| 10 | 0.124 | 21 | 0.417 | 181 | 0.779 | 412 |
| 60 | 0.288 | 44 | 0.545 | 315 | 0.936 | 701 |
| 300 | 0.389 | 63 | 0.690 | 313 | 1.069 | 767 |

All plates shown in Table 4 were highly hydrophilic in dry inking and aging test.

EXAMPLES 116 to 124

The procedure of Examples 59 to 67 was followed that the electrolyte concentration was 10.0%. The results are recorded in Table 5.

TABLE 5

| Time | 10% PVPA @ R.T. | | | | | |
|---|---|---|---|---|---|---|
| | 5 VDC | | 30 VDC | | 90 VDC | |
| (Seconds) | g/M² | $SnCl_2$ | g/M² | $SnCl_2$ | g/M² | $SnCl_2$ |
| 10 | 0.156 | 13 | 0.431 | 81 | 0.832 | 166 |
| 60 | 0.299 | 23 | 0.558 | 118 | 1.012 | 256 |

TABLE 5-continued

| Time (Seconds) | 10% PVPA @ R.T. 5 VDC g/M² | 5 VDC SnCl₂ | 30 VDC g/M² | 30 VDC SnCl₂ | 90 VDC g/M² | 90 VDC SnCl₂ |
|---|---|---|---|---|---|---|
| 300 | 0.417 | 27 | 0.701 | 112 | 1.046 | 244 |

All plates shown in Table 5 were highly hydrophilic in dry inking and aging test.

EXAMPLES 125 to 133

The procedure of Examples 59 to 67 was followed except that the electrolyte concentration was 30.0%. The results are given Table 6.

TABLE 6

| Time (Seconds) | 30% PVPA @ R.T. 5 VDC g/M² | 5 VDC SnCl₂ | 30 VDC g/M² | 30 VDC SnCl₂ | 90 VDC g/M² | 90 VDC SnCl₂ |
|---|---|---|---|---|---|---|
| 10 | 0.162 | 8 | 0.429 | 93 | 0.853 | 158 |
| 60 | 0.311 | 19 | 0.569 | 117 | 1.041 | 246 |
| 300 | 0.381 | 19 | 0.727 | 118 | 1.087 | 237 |

All plates shown in Table 6 were highly hydrophilic in dry inking aging tests.

EXAMPLES 134 to 144

The procedure of Examples 59 to 67 (1.0% PVPA) was followed, except that the temperature was 10° C. The results are shown in Table 7.

TABLE 7

| Time (Seconds) | 1.0% PVPA @ 10° C. 5 VDC g/M² | 5 VDC SnCl₂ | 30 VDC g/M² | 30 VDC SnCl₂ | 90 VDC g/M² | 90 VDC SnCl₂ |
|---|---|---|---|---|---|---|
| 1 | | | 0.222 | 42 | | |
| 5 | | | 0.282 | 66 | | |
| 10 | 0.084 | 47 | 0.368 | 98 | 0.802 | 197 |
| 60 | 0.093 | 66 | 0.453 | 137 | 0.901 | 263 |
| 300 | 0.099 | 77 | 0.469 | 132 | 0.943 | 253 |

All plates shwon in Table 7 were highly hydrophilic in dry inking and aging test.

EXAMPLES 145 to 156

The procedure of Examples 59 to 67 was followed except that the temperature was held at 40° C.

TABLE 8

| Time (Seconds) | 1.0% PVPA @ 40° C. 5 VDC g/M² | 5 VDC SnCl₂ | 30 VDC g/M² | 30 VDC SnCl₂ | 90 VDC g/M² | 90 VDC SnCl₂ |
|---|---|---|---|---|---|---|
| 1 | | | 0.187 | 9 | | |
| 5 | | | 0.201 | 17 | | |
| 10 | 0.079 | 13 | 0.311 | 36 | 0.742 | 95 |
| 60 | 0.090 | 13 | 0.417 | 59 | 0.857 | 171 |
| 300 | 0.098 | 13 | 0.450 | 54 | 0.867 | 198 |

All plates shown in Table 8 were highly hydrophilic in dry inking and aging tests.

EXAMPLES 156 to 170

Printing trials were conducted on some of the plates prepared in the previous examples. In all cases a Solna sheet fed press was used with a Dahlgren fountain solution at pH 3.9–4.0. Plates were overpacked 0.004 inches and printed with an abrasive ink which increased the normal wear rate by a factor of 2.4. The paper was Mead White Offset Moistrite Bond (20 lb.).

In the following table, the numbers indicate when dot sharpening and step-wedge rollback begins and not when the plate becomes unusable.

TABLE 9

| Example | Plate from Example # | Press Tests Description | Test (No. × 1000) DOT Sharpening | Stepwedge Rollback | End of Test |
|---|---|---|---|---|---|
| 156 | 52 | Slurry grained-thermally reacted with 0.2 PVPA | 50 | 20 | 105 |
| 157 | Table 3 | 30 VCD, 60 seconds | —(1) | —(1) | 105 |
| 158 | Table 3 | 60 VCD, 60 seconds | 95 | 90 | 105 |
| 159 | Table 3 | 30 VCD, 20 seconds | 80 | 50 | 105 |
| 160 | Table 3 | 30 VCD, 40 seconds | 100 | 80 | 105 |
| 161 | Table 3 | 30 VCD, 80 seconds | —(1) | —(1) | 105 |
| 162 | Exs. 35, 52 | Slurry grained, anodized with $H_2SO_4$ (1000 mg./M²) | 80 | 75 | 210 |
| 163 | Exs. 35, 52 | Same as 311, except anodic layer is 3000 mg./M² | 90 | 95 | 210 |
| 164 | Table 3 | 60 VCD, 20 seconds | 85 | 65 | 105 |
| 165 | Table 3 | 60 VCD, 40 seconds | 80 | 60 | 105 |
| 166 | Table 3 | 60 VCD, 80 seconds | 75 | 60 | 105 |
| 167 | Table 3 | 10 VCD, 30 seconds | 110 | 100 | 110 |
| 168 | Table 3 | 20 VCD, 30 seconds | 105 | 90 | 110 |
| 169 | Table 3 | 40 VCD, 30 seconds | 90 | 85 | 110 |
| 170 | Table 3 | 30 VCD, 30 seconds | 125 | 180 | 210 |

(1)No damage, even at end of test.

The controls are examples 156, 162 and 163 and are all commercially successful plates. The inventive plates outran the best control plates in seven cases in resistance to dot sharpening and four cases in step-wedge rollback. The inventive plates outran the intermediate control plate in nine cases in resistance to dot sharpening and in seven cases in step-wedge rollback. The inventive plates outran the poorest plate in 12 cases in resistance to dot sharpening and in 12 cases in step-wedge rollback.

EXAMPLE 171

In a procedure similar to that of Example 1, an anodic film was formed in a 1% phytic acid solution at 30 VDC for 60 seconds. TEM examination of the isolated aluminum oxide-organic film at 55,000X magnification showed a smooth and apparently structureless surface without visible porosity.

EXAMPLE 172

An anodic film was grown in 1% Gantrez® S-95 resin solution by a procedure similar to that of Example 1. TEM examination of the isolated aluminum oxide-organic film at 55,000X magnification showed a smooth surface with no visible porosity.

EXAMPLE 173

A section of 3003 alloy aluminum (6"×24") is degreased with an aqueous alkaline solution, mechanically roughened with an abrasive quartz slurry and then immersed in a 1.0% (w/w) aqueous solution of polyvinyl phosphonic acid. This solution is used and maintained at room temperature in a tank equipped with a source of rectified AC using a Wheatstone bridge. The electrode distance was 6.0 inches and the aluminum is made anodic with the lead plates being cathodic. A model DP 20-20-30 Series Pulse Plates made by Dynatronics, Inc. Div. of Nova Tran is used. Both sides are similarly treated using 30 VDC. 942 coulombs are consumed. After treatment, the plate is rinsed and blotted dry.

The plate treated in the above manner is found to have an oxide weight of 395 mg/m$^2$ and a resistance to saturated aqueous stannous chloride of 122 seconds. A dry ink test results in a surface face of ink which is removed with relative ease. It has a length of run of 48,000, when printed in the same manner as in Examples 156 to 170. The same printing procedure was used in all pulsed plating examples which follow.

EXAMPLE 174

A section of 3003 alloy aluminum (6"×24") is degreased with an aqueous alkaline solution and mechanically roughened with an abrasive quartz slurry, and is immersed in a 0.2% (w/w) solution of polyvinyl phosphonic acid at a temperature of 152° F. for 20 seconds with no electrolysis.

The plate is well rinsed and then blotted dry. The sample has a oxide weight of 37 mg/m$^2$ and a resistance time to stannous chloride of 6 seconds. A dry ink test results in a surface with some residual ink and is rather difficult to remove. On press, the run length is 36,000.

EXAMPLE 175

A section of 1100 alloy aluminum (6"×24") is degreased with an aqueous alkaline solution and electrochemically grained by using a solution of 10 g/1 $HNO_3$ and 30 g/1 $Al(NO_3)_3$. Alternating current is used at 40 amps/dm$^2$ for 60 seconds afterwhich it is rinsed and treated in 170 g/1 of $H_2SO_4$ at room temperature. A current density of 1.8 amps/dm$^2$ is maintained for 60 seconds while using direct current. The plate is well rinsed and immersed in a solution of polyvinyl phosphonic acid (0.2% w/w) for 20 seconds at 152° F. The sample is then rinsed and blotted dry. An oxide weight of 832 mg/m$^2$ and a stannous chloride resistance of 9 seconds are measured. The dry ink test results in a surface from which it is difficult to remove the ink. When removed there remained a tinted surface.

On press, the run length is 4,5000. Voltages from 1 to 30 VDC, in one volt increments, are used. The time off and time on are independently variable and go from 100$\mu$ seconds to 1.0 second.

Shunted into the system is an ampere-minute meter which directly translates into coulombs. This device eliminates time as a variable and allows for good correlation with standard rectified sine wave sources.

EXAMPLE 176

In like manner as described in Example 175 a plate is prepared except that in lieu of using a heated treatment of polyvinyl phosphonic acid, a 1.0% (w/w) solution is used at room temperature where the plate, having been made anodic, was treated with 30 VDC. The plate is then rinsed and blotted dry. An oxide weight of 1007 mg/m$^2$ and a stannous chloride resistance time of 137 seconds are measured. Dry inking is very good in that the ink is quickly removed without any background residue.

On press the run length is 132,000.

EXAMPLES 177-190

Table 10 summarizes the results one obtains when the procedure of the example indicated in column 2 is followed with the indicated process variants. One can readily notice the improved results when pulsed plating is employed.

TABLE 10

| Example | Substrate Prepared as in Ex. No. | Hydrophilizing Electrolyte | Electric or Thermal | Voltage | Pulsing Time Cycle On/Off (in m sec) | Oxide Weight mg/m$^2$ | $SnCl_2$ Sec | Dry Ink Test | Press Run |
|---|---|---|---|---|---|---|---|---|---|
| 177 | 173 | Polyvinyl Phosphonic Acid | E | 30 | 10.0/0.2 | 405 | 127 | VG | 84,000 |
| 178 | 173 | Polyvinyl Phosphonic Acid | E | 20 | 10.0/0.2 | 378 | 125 | VG | 60,000 |
| 179 | 173 | Polyvinyl Phosphonic Acid | E | 30 | 0.5/0.1 | 387 | 129 | VG | 72,000 |
| 180 | 173 | Polyvinyl Phosphonic Acid | E | 20 | 0.5/0.1 | 356 | 125 | VG | 72,000 |
| 181 | 173 | Polyvinyl Phosphonic Acid | E | 30 | 90.0/1.0 | 343 | 117 | VG | 60,000 |
| 182 | 173 | Polyvinyl Phosphonic Acid | E | 30 | 40.0/1.0 | 352 | 120 | VG | 60,000 |
| 183 | 173 | Polyvinyl Phosphonic Acid | E | 30 | 1.0/40.0 | 342 | 111 | G | 48,000 |
| 184 | 173 | Polyvinyl Phosphonic Acid | E | 30 | 1.0/90.0 | 333 | 109 | G | 48,000 |
| 185 | 176 | Polyvinyl Phosphonic Acid | E | 30 | 10.0/0.2 | 881 | 111 | VG | 156,000 |
| 186 | 173 | Phytic Acid | E | 30 | 0.5/0.1 | 218 | 117 | VG | 72,000 |
| 187 | 176 | Phytic Acid | E | 30 | 0.5/0.1 | 837 | 103 | VG | 144,000 |
| 188 | 173 | Gantrez An-119 | E | 20 | 10.0/0.2 | 157 | 97 | VG | 60,000 |
| 189 | 174 | Gantrez An-119 | T | N/A | N/A | 41 | 6 | F | 36,000 |
| 190 | 173 | Poly Benzene Phosphonic Acid | E | 20 | 10.0/0.2 | 153 | 93 | G | 60,000 |

What we claim is:

1. A process for preparing an element comprising;
(a) cleaning a metal article, and
(b) electrolyzing said metal article
made anode using a repetitive cycle pulsed direct current in an aqueous organic electrolytic solution having dissolved therein a water-soluble organic acid or mixture of two or more water-soluble organic acids which, if carboxylic be at least tribasic, under electrolytic conditions sufficient to form an insoluble substantially nonporous metal oxide organic complex, including said organic acid, bonded to the surface of said metal article, wherein said organic acid is present at a concentration of between about 0.05% and about 30% and said electrolysis is conducted at a voltage of at least about 1 volt, at an electrolysis time of between 0.08 minutes and about 5 minutes, and at an electrolyte temperature of between about −2° C. and about 60° C.

2. The process of claim 1 wherein the average current density ranges from about 1.0 amps/dm$^2$ to about 5.0 amps/dm$^2$.

3. The process of claim 1 wherein said water-soluble organic acid is selected from the group consisting of sulfonic, phosphonic, phosphoric, and tribasic or higher functionality carboxylic acids and mixtures of these.

4. The process of claim 1, wherein said water-soluble organic acid is selected from the group consisting of the condensation product of benzene phosphonic acid and formaldehyde, phytic acid, polyvinyl phosphonic acid, 2-ethyl polyphosphoric acid, and mixtures of these.

5. The process of claim 3, wherein the metal article is composed of aluminum or one of its alloys.

6. The process of claim 3, wherein the metal article is composed of magnesium.

7. The process of claim 3, wherein the metal article is composed of steel.

8. The process of claim 5, wherein said water-soluble organic acid is nitrilo triacetic acid.

9. The process of claim 5, wherein said water-soluble organic acid is 1,2,4,5 - benzene tetracarboxylic acid.

10. The process of claim 5, wherein said water-soluble organic acid is a condensation product of benzene phosphonic acid and formaldehyde.

11. The process of claim 5, wherein said water-soluble organic acid is a copolymer of methylvinyl ether and maleic anhydride.

12. The process of claim 5, wherein said water-soluble organic acid is polyvinyl sulfonic acid.

13. The process of claim 5, wherein said water-soluble organic acid is polystyrene sulfonic acid.

14. The process of claim 5, wherein said water-soluble organic acid is phytic acid.

15. The process of claim 5, wherein said water-soluble organic acid is alginic acid.

16. The process of claim 5, wherein said water-soluble organic acid is poly-n-butyl benzene sulfonic acid.

17. The process of claim 5, wherein said water-soluble organic acid is polydiisopropyl benzene sulfonic acid.

18. The process of claim 5, wherein said water-soluble organic acid is polyvinyl phosphonic acid.

19. The process of claim 5, wherein said water-soluble organic acid is dodecyl polyoxyethylene phosphoric acid.

20. The process of claim 5, wherein said water-soluble organic acid is dinonyl naphthalene disulfonic acid.

21. The process of claim 5, wherein said water-soluble organic acid is 2,2'-dinitro-4,4'-stilbene disulfonic acid.

22. The process of claim 5, wherein said water-soluble organic acid is diisopropyl polynaphthalene disulfonic acid.

23. The process of claim 5, wherein said water-soluble organic acid is 2-ethyl hexyl polyphoric acid.

24. The process of claim 5, wherein said water-soluble organic acid is dodecyl naphthalene disulfonic acid.

25. The process of claim 5, wherein said water-soluble organic acid is di-n-butyl naphthalene disulfonic acid.

26. The process of claim 5, wherein said water-soluble organic acid is polydecyl benzene sulfonic acid.

27. The process of claim 5, wherein said water-soluble organic acid is polyacrylic acid.

28. The process of claim 5, wherein said water-soluble organic acid is polymethacrylic acid.

29. The process of claim 5, wherein said water-soluble organic acid is diethylene diamine pentaacetic acid.

30. The process of claim 5, wherein said water-soluble organic acid is polynaphthalene sulfonic acid.

31. The process of claim 5, wherein said water-soluble organic acid is ethylenediamine tetraacetic acid.

32. The process of claim 5, wherein said water-soluble organic acid is hydroxyethyl ethylene diamine triacetic acid.

33. The process of claim 3, wherein said electrolyte solution has dissolved therein a mixture of two or more organic acids.

34. The process of claim 1, wherein said organic acid is present at a concentration of at least about 0.5%, said electrolysis is conducted at a voltage of between about 1.0 volts and about 30 volts, the average current density is between about 1.3 amperes/dm$^2$ and about 4.3 amperes/dm$^2$, the electrolysis time is between about 0.16 minutes and about 1 minute, and the electrolyte temperature is between about 10° C. and about 35° C.

35. The process of claim 1 wherein the potential on time and the potential off time per cycle each range from about 100 microseconds to about 1 second and the sum of potential on times is greater than the sum of potential off times.

36. The element produced by the method of claim 1, 3, 4, 5, 18, or 34.

37. The element produced by the method of claim 1 wherein said metal oxide-organic complex layer has a thickness of about 30 angstroms per volt.

38. The element produced by the method of claim 1 further coated with a light sensitive composition.

39. The element of claim 38 wherein the light sensitive coating contains a sensitizer selected from the group consisting of o-quinone diazides, condensation products of an aromatic diazonium compound and photopolymers.

* * * * *